United States Patent [19]

Holden

[11] Patent Number: 4,774,991

[45] Date of Patent: Oct. 4, 1988

[54] FORMING ROTARY GRINDING WHEEL DRESSERS

[75] Inventor: John A. Holden, Conway, Gwynedd, Wales

[73] Assignee: J. K. Smit & Sons Diamond Tools Ltd., North Wales, Wales

[21] Appl. No.: 894,000

[22] Filed: Aug. 7, 1986

[30] Foreign Application Priority Data

Aug. 8, 1985 [GB] United Kingdom ..... 8519905

[51] Int. Cl.[4] ..... B22D 19/14

[52] U.S. Cl. ..... 164/46; 164/97; 164/496; 29/527.3

[58] Field of Search ..... 164/46, 97, 98, 100–105, 164/495, 496, 508; 29/527.2, 527.3

[56] References Cited

U.S. PATENT DOCUMENTS 3,455,019 7/1969 Quaas ..... 164/97 X
4,373,933 2/1983 Grazen ..... 51/309
4,541,474 9/1985 Pecci ..... 164/46
4,610,320 9/1986 Beakley ..... 164/46 X

*Primary Examiner*—Kuang Y. Lin
*Attorney, Agent, or Firm*—Silverman, Cass, Singer & Winburn, Ltd.

[57] ABSTRACT

A mould 13 which may be of graphite, ceramic material, or metal is formed with an internal surface 14 accurately machined to the required shape of the surface of the rotary dresser which is being formed. Diamond particles 15 are then adhered to the surface 14 by any suitable adhesive. A metal surfacing powder is then applied to build up a metal layer 16 by means of an arc plasma spray surfacing gun 20 to melt the powder particles and a high velocity gas flow to propel the particles onto the diamond coated layer. A layer of a low melting point dimensionally stable alloy may be cast on top of metal layer 16 onto the internal bore. The mould 13 is then removed and the external surface accurately ground to final form. A supporting steel core may be added.

9 Claims, 1 Drawing Sheet

FORMING ROTARY GRINDING WHEEL DRESSERS

This invention relates to a method of forming rotary grinding wheel dressers or "truers".

Grinding wheel dressers or truers are known which have an external grinding or truing surface containing diamond in particulate form. The outer surface is extremely wear resistant and is supported by an inner core of metal. The present methods of making rotary grinding wheel dressers or truers are divided into two general classes, infiltration, and electro-forming.

When using infiltration a graphite or ceramic mould is precisely machined internally to the required external shape of the rotary dresser. Diamond is then attached to the surface walls in particulate form. Powdered metal, typically tungsten and iron, are placed in the graphite or ceramic mould and then heat is applied so as to infiltrate with a binder metal typically copper, nickel or zinc. The mould is then removed and the form produced may be diamond ground to final size.

In electro-forming a suitable mould is made from a conductive material such a graphite or metal, diamond is attached to the walls of the mould in particulate form, and the mould is then placed in an electro-plating bath which may be charged with nickel or chrome or copper or cadmium for example. The mould, positioned as a cathode, receives electro-deposition which eventually forms a coating containing the diamond on the inner walls of the mould. A low melting point metal is then cast into the mould which is also typically provided with a steel core.

The mould is then stripped from the form and the finish turning and diamond grinding operation is carried out.

Each of these processes has disadvantages when used to produce precision rotary grinding wheel dressers or truers. The disadvantages of the infiltration method are that the high temperature required to melt the infiltration metal affects the form finally produced because of thermally induced movement within the mould and shrinkage of the infiltrant metal. Corrective grinding of the diamond face and matrix metal has to be carried out in many cases.

The disadvantage of the electro-forming process is that very considerable time (as much as several weeks) is required to produce a thick stress-free layer of electro-plated metal sufficient to hold the diamond strongly in the form.

Clearly an improvement to these methods could theoretically be obtained by spraying liquid metal onto the walls of the mould or spraying metal powder onto the walls and then applying heat to melt the powder. But the presence of the diamond particles inhibits use of these methods because the heat of the molten metal, or the heat applied to melt the powder, would cause the diamond to become graphitised. Application of the heat also has the undesirable effect of causing movement or expansion and contraction of the basic mould which upsets the accuracy of the process.

In accordance with the present invention a method of forming a rotary grinding wheel truer or dresser comprises forming a mould having an internal surface of the general shape of the required truer or dresser, causing a layer of diamond particles to adhere to the internal surface of the mould, and then applying a layer of metal over the diamond covered surface by means of a plasma spray gun.

Preferably the plasma spray gun is inserted into the interior of the mould and then rotated so as to apply an even build-up of metal.

Preferably low melting point metal is cast into the mould over the layer of metal applied by the plasma gun.

The plasma spray gun is used to spray typical metallic surfacing powders. The arc is used to melt the powder particles and a high velocity gas flow propels the particles onto the surface. Coatings applied by the plasma spray process have superior bond strength compared with other coatings and although the arc flame used for the plasma coating is extremely hot, very little heat build-up occurs on the part during spraying. Coatings can thus be applied to the diamond surface without distorting the basic mould and without raising the temperature of the diamond surface unduly.

This is a most important aspect of the process. The use of the plasma spray gun enables the temperature of deposition of the metal to be kept low enough to avoid carbonisation or graphitisation of the diamond particles and to avoid problems resulting from expansion or movement of the mould due to the heat.

The plasma spray process using powder in very fine form is a one step process. It is not necessary to heat or re-melt the powder once it has been deposited on the surface. This gives the plasma process a tremendous advantage compared with spraying metal powders in the normal way when subsequent heating and re-melting of the powders is necessary.

Figure 1:
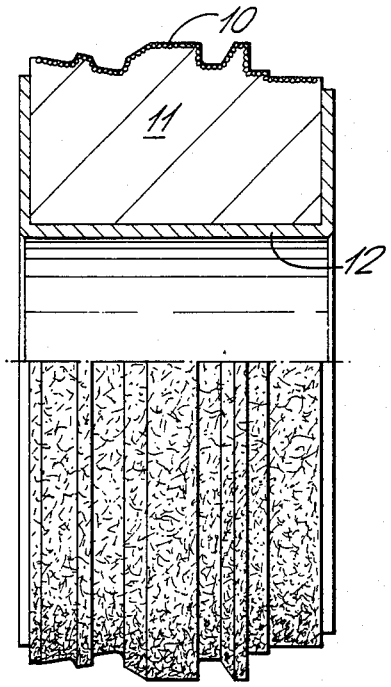
FIG. 1 is an elevation partly in section of a known type of rotary dresser or truer with a diamond external surface prepared by electro-forming.

The rotary grinding wheel truer or dresser shown in FIG. 1 comprises a diamond particle surface 10 which has been accurately ground or otherwise machined to provide a desired contour. The diamond surface 10 is formed on a base of metal such as nickel which has been formed by a lengthy electro-deposition process. Within the nickel base 11 is formed a steel core 12 so that the grinding wheel dresser or truer may be mounted on a lathe or other machine tool.

The process of the invention will now be described with reference to FIGS. 2 to 5 which show diagrammatically the steps in the process.

Figure 2:
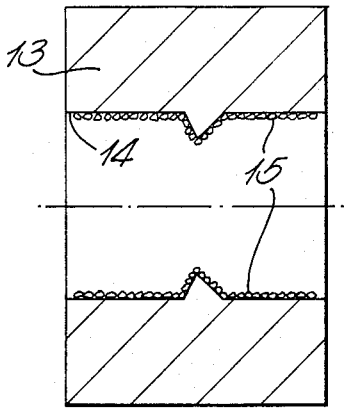
FIG. 2 illustrates a step in the process according to the invention in which a mould has an internal surface accurately prepared and then has diamond particles adhered to that surface.
Figure 3:
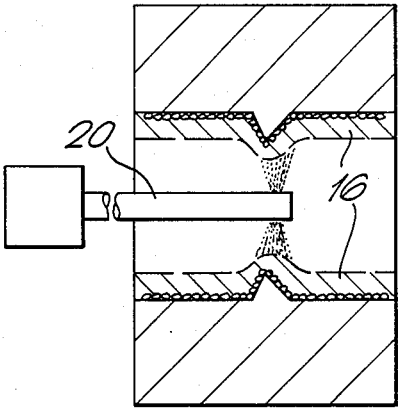
FIG. 3 shows the second step in the process in which plasma spray surfacing powders have been applied to the diamond covered surface so as to build-up a layer of metal.
Figure 4:
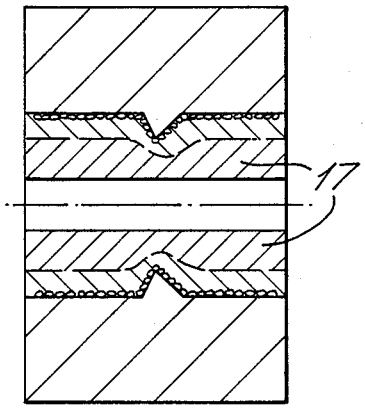
FIG. 4 illustrates the next stage in the process in which a low melting point metal has been cast into the mould over the layer of metal applied by the plasma gun.
Figure 5:
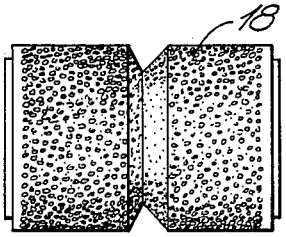
FIG. 5 shows the rotary grinding wheel dresser after the mould has been removed.

In FIG. 2 a mould 13 which may for example be of graphite, ceramic material, or metal has been formed with an internal surface 14 accurately machined to the required shape of the surface of the rotary dresser which is being formed.

Diamond particles 15 are then adhered to the surface 14 by any suitable adhesive.

A metal surfacing powder is then applied to buildup a metal layer 16 by means of a plasma spray surfacing gun 20 using an arc plasma to melt the powder particles and a high velocity gas flow to propel the particles onto the diamond coated layer.

A Metco-type 11 MB plasma spray gun may be employed (manufactured by Metco Inc. of Westbury, N.Y., U.S.A.). This is a plasma gun which is adapted for mounting on a machine such as a robot so that it can be inserted inside a bore and rotated to apply a layer of metal to an inside surface.

A typical plasma spray surfacing powder which may be used is cobalt based Stellite alloy No. 6 or Stellite alloy No. 51. Alternatively a nickel base alloy such as Haynes alloy No. 71 or Hastelloy alloy C may be used. These alloys and other typical surfacing alloy powders are manufactured by the Wear technology division of Cabot Corporation of Indiana, USA.

When the desire of thickness of metal has been built-up in layer 16 a layer of a low melting point dimensionally stable alloy may be cast at 17 (see FIG. 4) into the internal bore as shown. This low melting point alloy may for example be a bismuth-tin alloy.

The mould 13 is then removed and the external surface 18 (see FIG. 5) may then be accurately ground to final form.

A supporting steel core may be added similar to that shown in FIG. 1.

Instead of using an adhesive to cause the diamond particles to adhere to the surface 14 the diamond particles may be adhered to the surface by using an electroforming process e.g. by electroplating a thin layer of metal such as nickel or chrome over the diamonds and then continuing the process described above using plasma spray to build up a metal layer 16 on the electroplating layer.

What is claimed is:

1. A method of forming a rotary grinding wheel truer or dresser comprising forming a mould having an internal accurately formed surface of the general shape of the required truer or dresser, causing a layer of diamond particles to adhere to the internal surface of the mould, and then applying a layer of metal over the diamond covered surface by means of a plasma spray gun without substantially distorting said internal mould surface and without raising the temperature of said diamond particles unduly.

2. A method according to claim 1 and in which the plasma spray gun is inserted into the interior of the mould and then rotated so as to apply an even build-up of metal.

3. A method according to claim 1 and in which low melting point metal is cast into the mould over the layer of metal applied by the plasma gun.

4. A method according to claim 1 and in which plasma spray gun applies the layer of metal in the form of a fine powder which is melted in a one-step process, the process being completed without any remelting of the layer of metal.

5. A method according to claim 1 and in which the mould is of graphite and the diamond particles are adhered to the mould surface by adhesive prior to applying the metal layer.

6. A method according to claim 1 and in which the diamond particles are adhered to the mould surface by an electro-forming process.

7. A method according to claim 6 and in which said electro-forming process is electroplating.

8. A method according to claim 1 and in which the mould is of ceramic material and the diamond particles are adhered to the mould surface by adhesive prior to applying the metal layer.

9. A method according to claim 1 and in which the mould is of metal and the diamond particles are adhered to the mould surface by adhesive prior to applying the metal layer.

* * * * *